US007169542B2

(12) United States Patent
Kasperchik et al.

(10) Patent No.: US 7,169,542 B2
(45) **Date of Patent: *Jan. 30, 2007**

(54) COMPOSITIONS, SYSTEMS, AND METHODS FOR IMAGING

(75) Inventors: Vladek Kasperchik, Corvallis, OR (US); Makarand Gore, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 15 days.

This patent is subject to a terminal disclaimer.

(21) Appl. No.: 10/835,716

(22) Filed: Apr. 30, 2004

(65) Prior Publication Data

US 2005/0100817 A1 May 12, 2005
US 2006/0275693 A9 Dec. 7, 2006

Related U.S. Application Data

(63) Continuation-in-part of application No. 10/695,718, filed on Oct. 28, 2003, now Pat. No. 7,060,654.

(51) Int. Cl.
*G03C 1/73* (2006.01)
*G03C 5/16* (2006.01)

(52) U.S. Cl. ..... 430/343; 430/332; 430/333; 430/338; 430/340; 430/964; 503/214; 503/226

(58) Field of Classification Search ..... 430/332, 430/333, 340, 343, 338, 964; 503/214, 226
See application file for complete search history.

(56) References Cited

U.S. PATENT DOCUMENTS

| | | | | |
|---|---|---|---|---|
| 4,412,231 | A * | 10/1983 | Namba et al. | 346/135.1 |
| 5,153,106 | A * | 10/1992 | Liu | 430/340 |
| 5,543,382 | A | 8/1996 | Watanabe et al. | |
| 6,015,896 | A | 1/2000 | Mistry et al. | |
| 6,022,648 | A | 2/2000 | Jacobson et al. | |
| 6,025,486 | A | 2/2000 | Mistry et al. | |
| 6,251,571 | B1 | 6/2001 | Dessauer et al. | |
| 2002/0045548 | A1 | 4/2002 | Saito | |
| 2002/0089580 | A1 | 7/2002 | Suzuki et al. | |
| 2002/0183203 | A1 | 12/2002 | Hoefs et al. | |
| 2003/0003399 | A1 | 1/2003 | Muller et al. | |
| 2004/0146812 | A1* | 7/2004 | Gore et al. | 430/343 |
| 2005/0089782 | A1* | 4/2005 | Kasperchik et al. | 430/66 |

FOREIGN PATENT DOCUMENTS

EP 0 716 135 9/1999

OTHER PUBLICATIONS

H. Bouas-Laurent et al., "Organic Photochromism" (IUPAC Technical Report), Pure Appl. Chem., vol. 73, No. 4, pp. 639-665, 2001.

* cited by examiner

*Primary Examiner*—Richard L. Schilling

(57) ABSTRACT

A composition, method, and system for recording an image. The system includes a multiphase imaging material in which energy is absorbed by an antenna material. The absorbed energy causes the reaction of an activator and a color-forming material.

20 Claims, 1 Drawing Sheet

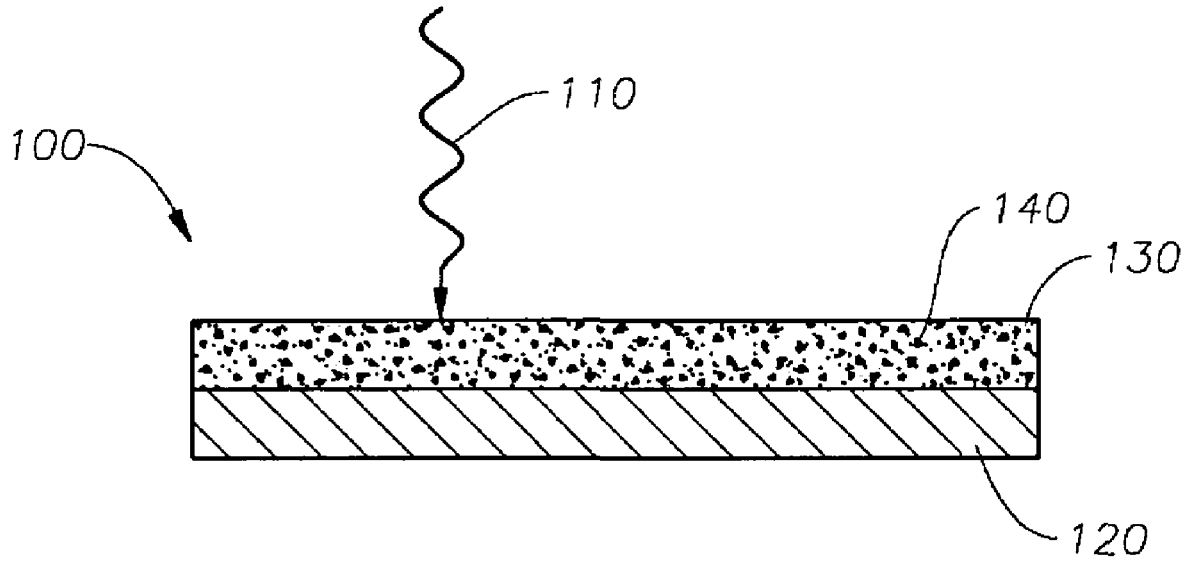
110
100
140
130
120

COMPOSITIONS, SYSTEMS, AND METHODS FOR IMAGING

RELATED APPLICATIONS

This application is a continuation-in-part of Ser. No. 10/695,718 Oct. 28, 2003 now U.S. Pat. No. 7,060,654.

BACKGROUND

Materials that produce color change upon stimulation with energy such as light or heat may have possible applications in imaging. For example, such materials may be found in thermal printing papers and instant imaging films. Generally, the materials and compositions known so far may require a multifilm structure and further processing to produce an image (e.g., instant imaging films). And in the case of facsimile and thermal head media, high energy input of greater than 1 J/cm$^2$ is needed to achieve good images. The compositions in multifilm media may require control of diffusion of color-forming chemistry and further processing, and are in separate phases and layers. Most thermal and facsimile paper coatings consist of coatings prepared by preparing fine dispersions of more than two components. The components mix and react upon application of energy, resulting in a colored material. To obtain the necessary mixing, the particles need to contact across three or more phases or layers and merge into a new phase. Because of these multiple phases and layers, high energy is required to perform this process. For example, a relatively powerful carbon dioxide laser with an energy density of 3 J/cm$^2$ at times of much greater than 100 μs may be needed to produce a mark. In some instances, this high energy application may cause damage to the imaging substrate. In many situations, it may be desirable to produce a visible mark more efficiently using either a less intense, less powerful, and/or shorter energy application. Therefore, there is a need for fast marking coatings, possibly composed of fewer than three phases and in single layer. Single layer color-forming materials, initiated and addressable by radiation, particularly with energy density of less than about 0.5 J/cm$^2$ delivered in less than 100 μs is hereto unknown.

SUMMARY

Disclosed herein are imaging materials. The materials disclosed herein may include an antenna, a color former and an activator, all dispersed in a matrix. The color former and the activator are present in the imaging material in two separate phases. The antenna readily absorbs energy which may be applied imagewise to the imaging materials.

BRIEF DESCRIPTION OF THE DRAWINGS

For a detailed description of embodiments of the invention, reference will now be made to the accompanying drawing showing an imaging medium according to embodiments of the present invention.

NOTATION AND NOMENCLATURE

Certain terms are used throughout the following description and claims to refer to particular system components. As one skilled in the art will appreciate, companies may refer to components by different names. This document does not intend to distinguish between components that differ in name but not function. In the following discussion and in the claims, the terms "including" and "comprising" are used in an open-ended fashion, and thus should be interpreted to mean "including, but not limited to . . . " The term "leuco dye" is a color forming substance which is colorless or one color in a non-activated state and produces or changes color in an activated state. As used herein, the term "activator" is a substance which reacts with a dye and causing the dye to alter its chemical structure and change or acquire color. By way of example only, activators may be phenolic or other proton donating species which can effect this change. The term "antenna" means any radiation absorbing compound the antenna readily absorbs a desired specific wavelength of the marking radiation.

DETAILED DESCRIPTION

The following discussion is directed to various embodiments of the invention. The embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Embodiments of the invention include coatings that result in clear marks and excellent image quality when marked with a 650 nm laser operating at 25–45 mw. The materials used to produce color change upon stimulation by energy may include a color-former such as a fluoran leuco dye and an activator such as sulphonylphenol dispersed in a matrix such as radiation-cured acrylate oligomers and monomers and applied to a substrate. In particular embodiments, either the leuco dye or the activator may be substantially insoluble in the matrix at ambient conditions. An efficient radiation energy absorber that functions to absorb energy and deliver it to the reactants is also present in this coating. Energy may then be applied by way of, for example, a laser. Upon application of the energy, either the activator, the color-former, or both may become heated and mix which causes the color-former to become activated and a mark to be produced.

Referring now to the embodiments illustrated in the drawing, there is shown imaging medium 100, energy 110, substrate 120, imaging composition 130, and suspended particles 140. Imaging medium 100 may comprise a substrate 120. Substrate 120 may be substrate upon which it is desirable to make a mark, such as, by way of example only, paper (e.g., labels, tickets, receipts, or stationary), overhead transparencies, or the labeling surface of a medium such as a CD-R/RW/ROM or DVD±R/RW/ROM.

Imaging composition 130 may comprise a matrix, an activator, a radiation absorbing compound such as a dye, and a color forming dye. The activator and the color forming dye, when mixed, may change color. Either of the activator and the color forming dye may be soluble in the matrix. The other component (activator or color forming dye) may be substantially insoluble in the matrix and may be suspended in the matrix as uniformly distributed particles 140. The imaging composition 130 may be applied to the substrate via any acceptable method, such as, by way of example only, rolling, spraying, or screen printing.

Energy 110 may be directed imagewise to imaging medium 100. The form of energy may vary depending upon the equipment available, ambient conditions, and desired result. Examples of energy which may be used may include red laser radiation at a wavelength of about 650+/−10 nm at 22° C. The wavelength of LASER emission may shift +/−30 nm depending upon temperature. The dyes and compositions are selected such that absorption of films and shift in absorbance is compatible with the LASER frequency shift. The antenna may absorb the energy and heat the imaging composition 130. The heat may cause suspended particles 140 to reach a temperature sufficient to cause the interdiffusion of the color forming species initially present in the particles (e.g., glass transition temperatures ($T_g$) or melting temperatures ($T_m$) of particles 140 and matrix). The activator and dye may then react to form a color.

Examples 1 and 2 illustrate embodiments of the present invention. Several modifications may be made that are within the scope of the present invention. By way of example only, the following compounds Dye 724, (Formula 1) ($\lambda_{max}$=642 nm in MeOH), Dye 683, (Formula 2) ($\lambda_{max}$=642 nm in MeOH), or Oxazine 1 (3,7-bis(diethylamino)phenothiazin-5-ium perchlorate)(Formula 3) ($\lambda_{max}$=645 nm in EtOH) may be suitable antennae.

(1)

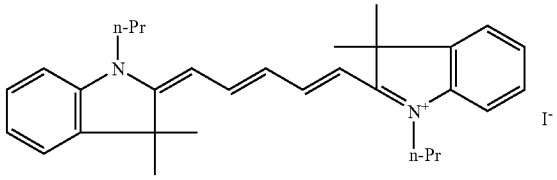

(2)

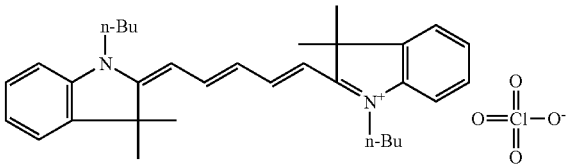

(3)

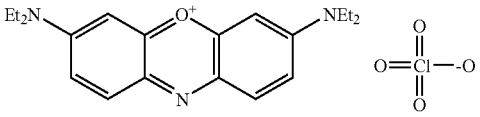

Other embodiments may include oxazine variations, such as phenothiazine dye basic blue 9 (Formula 4) ($\lambda_{max}$=661 nm in $H_2O$), and celestine blue (Formula 5) ($\lambda_{max}$=642 nm in $H_2O$).

(4)

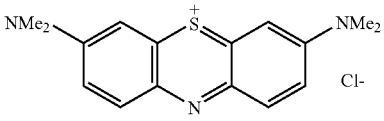

(5)

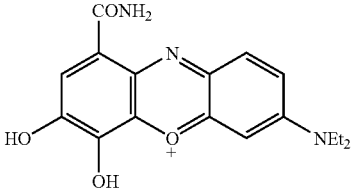

A number of additional classes of dyes can be used to tailor the solubility, stability and absorbance, properties. Other examples include phenanthrodiisoquinoline dyes (Formula 6) ($\lambda_{max}$=655 nm in $CH_2Cl_2/CF_3COOH$).

(6)

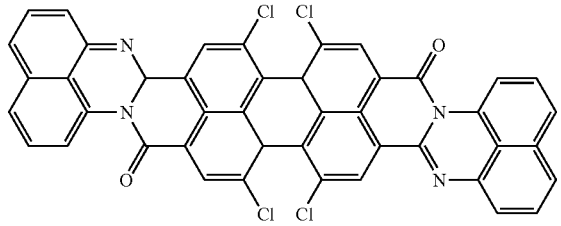

Yet another example is the use of squarilium dyes, such as (Formula 7) ($\lambda_{max}$=654 nm in cholorform) and (Formula 8) ($\lambda_{max}$=664 nm in methanol). In general squarilium dyes with the 2-oxo-cyclobuten-4-olate ring with aromatic groups can be chosen to match the absorption and solubility.

(7)

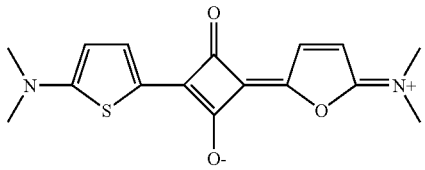

(8)

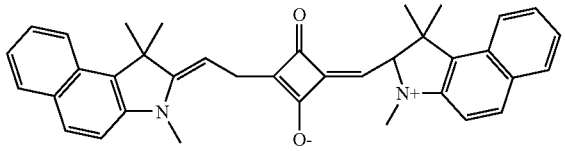

Metal complex dyes can be used, for example, in combination with cyanine dyes such as compounds of Formulas 1, 2, and 3 to afford photo-stability. An example of a metal complex dye is (Formula 9) ($\lambda_{max}$=624 nm in acetone).

(9)

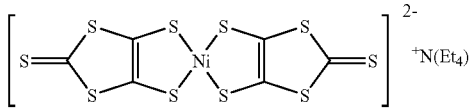

Anthraquinone dyes such as acid green 25 (Formula 10) ($\lambda_{max}$=642 nm in $H_2O$), may also be suitable for use as absorbers in some embodiments.

(10)

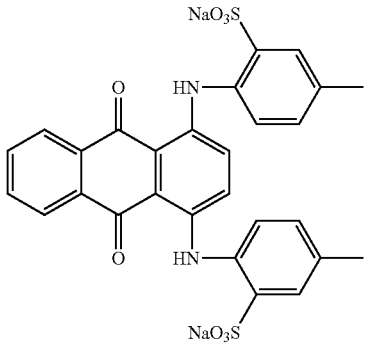

In other examples, triphenylmethane dyes, with polar groups such as Alphazurine A (acid blue 7) (Formula 11) ($\lambda_{max}$=637 nm in $H_2O$) may be used as absorbers.

(11)

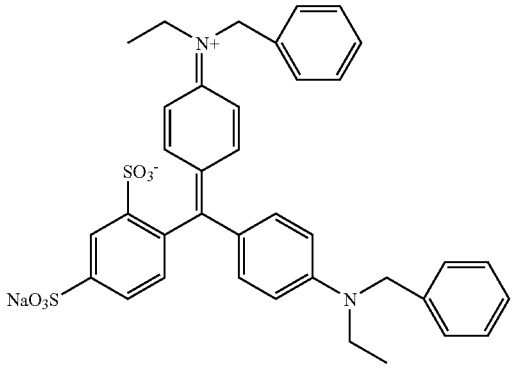

It is anticipated that the antenna may have a blue or blue-green coloration. Thus, it may be desirable in some instances to use leuco dyes which form a color other than blue or blue-green to achieve visible contrast.

Additional examples of antennae can be found in "Infrared Absorbing Dyes", Matsuoka, Masaru, ed., Plenum Press (1990) (ISBN 0-306-43478-4) and "Near-Infrared Dyes for High Technology Applications", Daehne, S.; Resch-Genger, U.; Wolfbeis, O., Ed., Kluwer Academic Publishers (ISBN 0-7923-5101-0).

The activator (e.g., bisphenol-A) and color-forming dye 90 (e.g., (2'-anilino-3'-methyl-6'-(dibutylamino)fluoran)) may act in tandem to produce a mark. The activator and dye may be any two substances which when reacted together produce a color change. When reacted, the activator may initiate a color change in the dye or develop the dye. One of the activator and the dye may be soluble in the matrix (e.g., lacquer 30) at ambient conditions. The other may be substantially insoluble in the lacquer at ambient conditions. By "substantially insoluble," it is meant that the solubility of the other in the lacquer at ambient conditions is so low, that no or very little color change may occur due to reaction of the dye and the activator at ambient conditions. Although, in the embodiments described above, the activator may be dissolved in the lacquer and the dye remains suspended as a solid in the matrix at ambient conditions, it is also acceptable that the color former may be dissolved in the matrix and the activator may remain as a suspended solid at ambient conditions. Activators may include, without limitation, proton donors and phenolic compounds such as bisphenol-A, bisphenol-S, p-hydroxy benzyl benzoate, phenol, 4,4'-sulfonylbis[2-(2-propenyl)] (Formula 12).

(12)

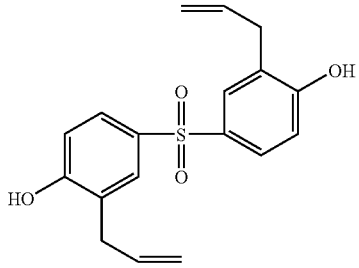

and poly-phenols. Color formers may include, without limitation, leuco dyes such as fluoran leuco dyes and phthalide color formers as described in "The Chemistry and Applications of Leuco Dyes", Muthyala, Ramiah, ed., Plenum Press (1997) (ISBN 0-30645459-9). Nonexclusive examples of acceptable fluoran leuco dyes comprise the structure shown in Formula (13)

(13)

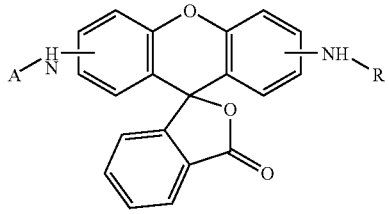

where A and R are aryl or alkyl groups.

The leuco dye may also be present as a separate phase in the form of a low-melting eutectic. The eutectic may comprise an alloy of fluoran dye and a melting aid.

Melting aids may include crystalline organic solids with melting temperatures in the range of about 50° C. to about 150° C., and alternatively melting temperature in the range of about 70° C. to about 120° C. Suitable accelerators may include aromatic hydrocarbons (or their derivatives) that provide good solvent characteristics for leuco dye and antennas. The melting aid may assist in reducing the melting temperature of the leuco dye and stabilize the leuco dye alloy in the amorphous state (or slow down the recrystallization of the leuco dye alloy into individual components). Suitable melting aids for use in the current invention may include, but are not limited to, m-terphenyl, p-benzyl biphenyl, β-naphtol benzylether, and 1,2[bis(3,4]dimethylphenyl) ethane.

Embodiments may include almost any known leuco dye, including, but not limited to, fluorans, phthalides, aminotriarylmethanes, aminoxanthenes, aminothioxanthenes, amino-9, 10-dihydro-acridines, aminophenoxazines, aminophenothiazines, aminodihydro-phenazines, aminodiphenylmethanes, aminohydrocinnamic acids (cyanoethanes, leuco methines) and corresponding esters, 2(p-hydroxyphenyl)-4,5-diphenylimidazoles, indanones, leuco indamines, hydrozines, leuco indigoid dyes, amino-2,3-dihydroanthraquinones, tetrahalo-p, p'-biphenols, 2(p-hydroxyphenyl)-4,5-diphenylimidazoles, phenethylanilines, and mixtures thereof. In other embodiments, the leuco dye may comprise a fluoran, phthalide, aminotriarylmethane, or mixture thereof. Several non-limiting examples of suitable fluoran based leuco dyes may include 3-diethylamino-6-methyl-7-anilinofluorane, 3-(N-ethyl-p-toluidino)-6-methyl-7-anilinofluorane, 3-(N-ethyl-N-isoamylamino)-6-methyl-7-anilinofluorane, 3-diethylamino-6-methyl-7-(o,p-dimethylanilino)fluorane, 3-pyrrolidino-6-methyl-7-anilinofluorane, 3-piperidino-6-methyl-7-anilinofluorane, 3-(N-cyclohexyl-N-methylamino)-6-methyl-7-anilinofluorane, 3-diethylamino-7-(m-trifluoromethylanilino) fluorane, 3-dibutylamino-6-methyl-7-anilinofluorane, 3-diethylamino-6-chloro-7-anilinofluorane, 3-dibutylamino-7-(o-chloroanilino)fluorane, 3-diethylamino-7-(o-chloroanilino) fluorane 3-di-n-pentylamino-6-methyl-7-anilinofluoran, 3-di-n-butylamino-6-methyl-7-anilinofluoran, 3-(n-ethyl-n-isopentylamino)-6-methyl-7-anilinofluoran, 3-pyrrolidino-6-methyl-7-anilinofluoran, 1(3H)-isobenzofluranone, 4,5,6,7-tetrachloro-3,3-bis [2-[4-(dimethylamino)phenyl]-2-(4-methoxyphenyl)ethenyl], and mixtures thereof. Aminotriarylmethane leuco dyes may also be used in the present invention such as tris (N,N-dimethylaminophenyl) methane; tris(N,N-diethylaminophenyl) methane; tris(4-diethylaminophenyl) methane; tris(N,N-di-n-propylaminophenyl) methane; tris(N,N-din-butylaminophenyl) methane; bis(4-diethylaminophenyl)-(4-diethylamino-2-methylphenyl) methane; bis(4-diethylamino-2-methylphenyl)-(4-diethylamino-phenyl) methane; tris(4-diethylamino-2-methylphenyl) methane; bis (4-diethylamino-2-methylphenyl) (3,4-diemethoxyphenyl) methane; aminotriarylmethane leuco dyes having different alkyl substituents bonded to the amino moieties wherein each alkyl group is independently selected from C1–C4 alkyl; and aminotriaryl methane leuco dyes with any of the preceding named structures that are further substituted with one or more alkyl groups on the aryl rings wherein the latter alkyl groups are independently selected from C1–C3 alkyl.

Lacquer 30 may be any suitable matrix for dissolving and/or dispersing the activator, antenna, and color former (or color former/melting aid alloy). Acceptable lacquers may include, by way of example only, UV curable matrices such as acrylate derivatives, oligomers and monomers, with a photo package. A photo package may include a light absorbing species which initiates reactions for curing of a lacquer, such as, by way of example, benzophenone derivatives. Other examples of photoinitiators for free radical polymerization monomers and pre-polymers include but are not limited to: thioxanethone derivatives, anthraquinone derivatives, acetophenones and benzoine ether types. It may be desirable to choose a matrix which is cured by a form of radiation other than the type of radiation which causes a color change. Matrices based on cationic polymerization resins may require photo-initiators based on aromatic diazonium salts, aromatic halonium salts, aromatic sulfonium salts and metallocene compounds. An example of an acceptable lacquer or matrix may include Nor-Cote CLCDG-1250A or Nor-Cote CDG000 (mixtures of UV curable acrylate monomers and oligomers) which contains a photoinitiator (hydroxy ketone) and organic solvent acrylates (e.g., methyl methacrylate, hexyl methacrylate, beta-phenoxy ethyl acrylate, and hexamethylene acrylate). Other acceptable lacquers or matrices may include acrylated polyester oligomers such as CN292, CN293, CN294, SR351 (trimethylolpropane tri acrylate), SR395 (isodecyl acrylate), and SR256 (2(2-ethoxyethoxy) ethyl acrylate) available from Sartomer Co.

EXAMPLES

Example 1

9.05 g of m-terphenyl was melted in a heated crucible. 90.45 g of (2'-anilino-3'-methyl-6'-(dibutylamino)fluoran) (Formula 14) was added to the melted m-terphenyl. The mixture was heated to 180° C. and mixed until complete dissolution. 0.5 g of (1,1'-dibutyl-3,3,3',3'-tetramethylindadicarbocyanine perchlorate) (available from Organica Feinchemie GmbH Wollen) was dissolved in the melt. The resulting mixture was quickly cooled and ground into a fine powder of average particle size 2–7 μm to form the sensitized eutectic.

(14)

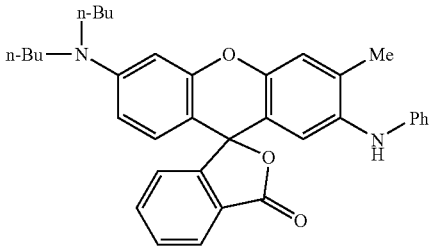

9 g of finely ground Bisphenol S (phenol, 4,4'-sulfonylbis) and 0.25 g of Dye 783 were added into 47.3 g of CLCDG-1250A UV-curable lacquer and left mixing overnight. 6.6 g of zinc stearate powder and 2 g of Darocur 4265 photoinitiator (available from Ciba Specialty Chemicals, 540 White Plains Rd., PO Box 2005, Tarrytown, N.Y. 10591) where then added. Finally, 31.7 g of the sensitized eutectic powder described in the preceding paragraph was added to form a UV-curable thermochromic paste. To ensure mixing uniformity, the paste was run through a three roll mill three times.

The resulting paste was screen printed onto a substrate at a thickness of approximately 5–7 μm to form an imaging medium. The coating was then UV cured by a mercury lamp and then directly marked by a 20 mW red (650 nm) laser with energy applications of duration of about 30 μsec to about 100 μsec. Marks of approximately 7 μm×45 μm were produced.

Example 2

9.05 g of m-terphenyl was melted in a heated crucible. 90.45 g of (2'-anilino-3'-methyl-6'-(dibutylamino)fluoran) was added to the melted m-terphenyl. The mixture was heated to 180° C. and mixed until complete dissolution. 0.5 g of (1,1'-dipropyl-3,3,3',3'-tetramethylindadicarbocyanine iodide) (available from Organica Feinchemie GmbH Wollen) was dissolved in the melt. The resulting sensitized eutectic mixture was quickly cooled and ground into a fine powder of average particle size 2–7 μm.

9.09 g of m-terphenyl was melted in a heated crucible. 0.91 g of 1,1'-dipropyl-3,3,3',3'-tetramethylindadicarbocyanine iodide was added to the melt and mixed until completely dissolved. The antenna alloy mixture was cooled down and ground into a fine powder.

9 g of finely ground Bisphenol S and 3.4 g of the antenna alloy were added into 47.3 g of CLCDG-1250A UV-curable lacquer and left mixing overnight. 6.6 g of zinc stearate powder and 2 g of Darocur 4265 photoinitiator were added into the mixture. Finally, 31.7 g of the sensitized eutectic were combined with the resulting lacquer mix to form a UV-curable thermochromic paste. To ensure mixing uniformity, the paste was run through a three roll mill three times.

The resulting paste was screen printed onto a substrate at a thickness of approximately 5–7 μm to form an imaging medium. The coating was then UV cured by a mercury lamp and then directly marked by a 20 mW red (650 nm) laser with energy applications of duration of about 30 μsec to about 100 μsec. Marks of approximately 7 μm×45 μm were produced.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. An imaging composition comprising:

a matrix an antenna dissolved in the matrix;

a color former; and an activator;

wherein the antenna is tuned to absorb radiation with a wavelength of about 620 nm to about 680 nm;

wherein one of the activator and the color former is soluble in the matrix or matrix precursor at ambient conditions;

wherein the soluble of the activator and the color former is dissolved in the matrix; and wherein the other of the activator and the color former is substantially uniformly dispersed in the matrix.

2. The imaging composition of claim 1 wherein the antenna is tuned to absorb radiation with a wavelength of about 650 nm.

3. The imaging composition of claim 2 wherein the antenna is selected from the group consisting of salts of 1,1'-dipropyl-3,3,3',3'-tetramethylindadicarbocyanine, salts of 1,1'-dibutyl-3,3,3',3'-tetramethylindadicarbocyanine, and salts of 3,7-bis(diethylamino)phenothiazin-5-ium.

4. The imaging composition of claim 1 wherein the color former is a leuco dye.

5. The imaging composition of claim 1 wherein the color former is alloyed with a melting aid.

6. The imaging composition of claim 5 wherein the alloy is a eutectic mixture.

7. The imaging composition of claim 5 wherein the melting aid is selected from the group consisting of m-terphenyl, p-benzyl, biphenyl, β-naphtol benzyl ether, and 1,2[bis(3,4]dimethylphenyl)ethane.

8. An image recording medium, the medium comprising:

a substrate, an imaging compound comprising:a matrix; an antenna dissolved in the matrix; a dye; and an activator;

wherein the antenna is tuned to absorb radiation with a wavelength of about 620 nm to about 680 nm;

wherein one of the activator and the dye is soluble in the matrix or matrix precursor at ambient conditions;

wherein the soluble of the activator and the color former is dissolved in the matrix; and wherein the other of the activator and the color former is substantially uniformly dispersed in the matrix.

9. The image recording medium of claim 8 wherein the antenna is tuned to absorb radiation with a wavelength of about 650 nm.

10. The image recording medium of claim 8 wherein the antenna is selected from the group consisting of salts of 1,1'-dipropyl-3,3,3',3'-tetramethylindadicarbocyanine, salts of 1,1'-dibutyl-3,3,3',3'-tetramethylindadicarbocyanine, and salts of 3,7-bis(diethylamino)phenothiazin-5-ium.

11. The image recording medium of claim 8 wherein the dye is a leuco dye.

12. The image recording medium of claim 8 wherein the dye is alloyed with a melting aid.

13. The image recording medium of claim 12 wherein the alloy is a eutectic mixture.

14. The image recording medium of claim 12 wherein the melting aid is selected from the group consisting of m-terphenyl, p-benzyl, biphenyl, β-naphtol benzyl ether, and 1,2(bis(3,4)dimethylphenyl)ethane.

15. A means for imaging comprising:

a means for absorbing energy with a wavelength of about 620 nm to about 680 nm;

a means for coloring;

a means for activating the means for coloring;

a means for binding the activating means, the coloring means, and the absorbing means;

wherein the means for absorbing is dissolved in the binder;

wherein one of the means for coloring and the means for activating is soluble in the means for binding at ambient conditions;

wherein the other of the means for coloring and the means for activating is substantially insoluble in the means for binding at ambient conditions; and wherein the insoluble component is substantially uniformly distributed in the binder.

16. The means for imaging of claim 15 wherein the coloring means comprises an alloy of a color former and a means for assisting melting.

17. The means for imaging of claim 16 wherein the means for assisting melting is selected from the group consisting of m-terphenyl, p-benzyl, biphenyl, β-naphtol benzylether, and 1,2(bis(3,4)dimethylphenyl)ethane.

18. The means for imaging of claim 16 wherein the alloy is a eutectic mixture.

19. The means of imaging of claim 15 wherein the means for absorbing is selected from the group consisting of salts of 1,1'-dipropyl-3,3,3',3'-tetramethylindadicarbocyanine, salts of 1,1'-dibutyl-3,3,3',3'-tetramethylindadicarbocyanine, and salts of 3,7-bis(diethylamino)phenothiazin-5-ium.

20. The means of imaging of claim 15 wherein the means for absorbing absorbs energy with a wavelength of about 650 nm.

* * * * *